US005682650A

United States Patent [19]

Noguchi et al.

[11] Patent Number: 5,682,650

[45] Date of Patent: Nov. 4, 1997

[54] SHEET CLIPPING DEVICE

[75] Inventors: Toshio Noguchi, Matsudo; Yasushi Yamaguchi, Tokyo; Takatoshi Suzuki, 1848-36 Abiko, Abiko, Chiba, all of Japan

[73] Assignees: Colleague Agencies, Inc., Tokyo; Takatoshi Suzuki, Abiko, both of Japan

[21] Appl. No.: 708,837

[22] Filed: Sep. 9, 1996

Related U.S. Application Data

[63] Continuation-in-part of Ser. No. 563,095, Nov. 27, 1995, Pat. No. 5,608,950.

[51] Int. Cl.[6] ..... A44B 1/00

[52] U.S. Cl. ..... 24/67.3; 24/67 R; 24/346; 24/545

[58] Field of Search ..... 24/67.3, 67 R, 24/545, 546, 547, 531, 346

[56] References Cited

U.S. PATENT DOCUMENTS

| | | | |
|---|---|---|---|
| 549,660 | 11/1895 | Rodden | 24/67.3 |
| 857,488 | 6/1907 | Rosenthal | 24/67 R |
| 1,539,457 | 5/1925 | Berneburg | 24/67.3 |
| 1,736,558 | 11/1929 | Van Buren | 24/67.3 |
| 2,861,309 | 11/1958 | Saviolides | 24/67 R |
| 3,600,764 | 8/1971 | Froehlich, Jr. | 24/545 |
| 3,806,995 | 4/1974 | Gass | 24/346 |
| 5,086,545 | 2/1992 | Suzuki | 24/67 R |

*Primary Examiner*—Victor N. Sakran
*Attorney, Agent, or Firm*—Kanesaka & Takeuchi

[57] ABSTRACT

A sheet clipping device of the invention is designed to detachably hold one or more sheets. The sheet clipping device is formed of an elongated base member, and a plurality of gripping devices fixed to the elongated base member at a predetermined distance away from each other along the longitudinal direction thereof. The elongated base member is formed of upper and lower portions with diagonal upper and lower guide members, and a back portion situated between the upper and lower portions. Distal ends of the upper and lower guide members are vertically spaced apart from each other. Each gripping device includes an upper frictional member fixed to the upper portion, and a lower frictional member fixed to the lower portion to face to each other. When the sheets are inserted between the upper and lower frictional members through the guide members, the sheets are frictionally retained between the frictional members. The sheets can be easily attached to or removed from the clipping device.

8 Claims, 2 Drawing Sheets

SHEET CLIPPING DEVICE

CROSS-REFERENCE TO RELATED APPLICATION

This is a continuation in part application of Ser. No. 08/563,095 filed on Nov. 27, 1995, now U.S. Pat. No. 5,608,950.

BACKGROUND OF THE INVENTION AND RELATED ART STATEMENT

The present invention relates to a sheet clipping device for clipping or holding one or more sheets easily without making holes to the sheets or using pins.

When the sheets or documents are assembled or attached together, the sheets may be often connected together by a staple. Instead of using the staple, holes may be formed in the sheets, and a strap or the like may be inserted into the holes to tie or assemble together. In these methods, since the staple is attached or the holes are formed, the sheets are damaged. Also, in case a sheet disposed in a middle of documents is removed, all the sheets must be separated. Therefore, it takes time and trouble to remove a middle sheet from the documents.

In case the staples or holes are not utilized, a spring type binding clip, or a device for binding sheets by a spring may be utilized. In this case, when the sheets are assembled, added or removed, the spring must be released by the user.

In U.S. Pat. No. 5,086,545, a paper clip for gripping a sheet or sheets is formed of first and second brush plates facing to each other. When one or more sheets are inserted between the first and second brush plates, the sheets are frictionally retained between the brush plates. The paper clip can properly hold the sheets at one point, but when the paper clip is fixed, the sheets can not be easily inserted nor aligned properly.

In view of the conventional file and the paper clip, the present invention has been made.

An object of the invention is to provide a clipping device, wherein one or more sheets can be easily attached to or detached from the clipping device without using pins or holes.

Another object of the invention is to provide a clipping device as stated above, wherein a part of the sheets attached to the clipping device can be easily removed therefrom, or one or more sheets can be easily added to the clipping device in a condition where some sheets are already attached to the clipping device.

A further object of the invention is to provide a clipping device as stated above, wherein the clipping device can be easily fixed to a desired place.

A still further object of the invention is to provide a clipping device as stated above, wherein a small or large size sheet can be easily attached to the clipping device.

Further objects and advantages of the invention will be apparent from the following description of the invention.

SUMMARY OF THE INVENTION

A sheet clipping device of the invention is designed to hold one or more sheets easily. The clipping device is formed of an elongated base member, and a plurality of gripping devices fixed to the elongated base member. The gripping devices are spaced apart from each other for a predetermined distance and are arranged along a longitudinal direction of the elongated base member.

The base member is formed of upper and lower portions disposed substantially parallel to each other, a back portion situated between the upper and lower portions at a back side thereof, and upper and lower guide members attached to the upper and lower portions, respectively. The upper and lower guide members face to each other and extend diagonally from a front side to the back side. The distal ends of the upper and lower guide members are vertically spaced apart from each other, so that when the sheets are inserted between the upper and lower portions, the sheets are guided into a space between the upper and lower portions.

Each gripping device has upper and lower frictional members, which face to each other. The upper frictional member is fixed to the upper portion, and the lower frictional member is fixed to the lower portion. When the sheets are inserted between the upper and lower frictional members, the sheets are frictionally retained between the frictional members.

In the invention, the sheets can be easily inserted between the upper and lower frictional members through the upper and lower guide members, and can be removed therefrom. One or more sheets can be easily added in any portions between the upper and lower frictional members, i.e. above an upper sheet, below a lower sheet or between the sheets. Also, one or more sheets can be easily taken out from the sheets held between the upper and lower frictional members without removing other sheets.

In the invention, since the upper and lower frictional members are formed to be spaced apart from each other in the longitudinal direction of the elongated base member, the sheet can be held in any places inside the elongated base member. Also, when the sheets are inserted into the space in the elongated base member, the sheets can be aligned by the back portion of the elongated base member. The sheets can be retained by the frictional members regardless the position, size and kind of the sheets. Insertion and removal of the sheets can be made by single action with one hand.

The elongated base member may have a fixing member, such as adhesive or magnet, attached to the lower portion of the base member, so that the lower portion can be fixed to a desired place by the fixing member. The base member may be fixed permanently to a desired place.

In the sheet clipping device, the front side may be oriented downwardly to hang one or more sheets. The frictional members can hold the sheets sufficiently. The sheet clipping device may be used as a file, as disclosed in U.S. patent application Ser. No. 08/563,095.

In the invention, the upper frictional members may be integrally connected together as one unit, and the lower frictional members may be also connected together as one unit. The respective units are fixed to the upper and lower portions. In particular, each of the upper and lower frictional members is formed of one base, and a plurality of flexible hairs extending diagonally from the base. The hairs are arranged parallel to each other.

Each frictional member has a plurality of groups of hairs. On group has at least two hairs extending from the front side to the back side. Preferably, four hairs are arranged in a rectangular shape such that one corner is located close to the front side.

The mechanism and structure of the upper and lower frictional members are similar to brush plates with hairs as disclosed in U.S. Pat. No. 5,086,545, though the size of the brush plate and the arrangement of the hairs are different. The explanation of the brush plates with hairs as disclosed in U.S. Pat. No. 5,086,545 are incorporated in the application.

In the invention, the upper and lower guide members extend substantially throughout the entire lengths of the upper and lower portions, respectively. Also, the groups of hairs are disposed laterally away from each other throughout the entire length of the elongated base member. Thus, the sheets can be guided and held by the hairs at any portions of the elongated base member. Also, the lengths of the lower portion and the lower guide member from the front side to the back side is longer than those of the upper portion and the upper guide members. Thus, the sheets can be easily inserted into the space between the upper and lower guide members.

DETAILED DESCRIPTION OF PREFERRED EMBODIMENTS

The sheet clipping device of the invention is designed to be attached to a desired place, such as a wall or a board, permanently. Also, the sheet clipping device may be attached to a small board for carrying, such as a clipping board or a block or white board. If one or more sheets are to be attached or hang, the sheet clipping device of the invention can be utilized.

The sheet clipping device of the invention can clip or hold one or more sheets. One or more sheets can be easily added to or taken out from a pile of the sheets held in the sheet clipping device without trouble.

Figure 1:
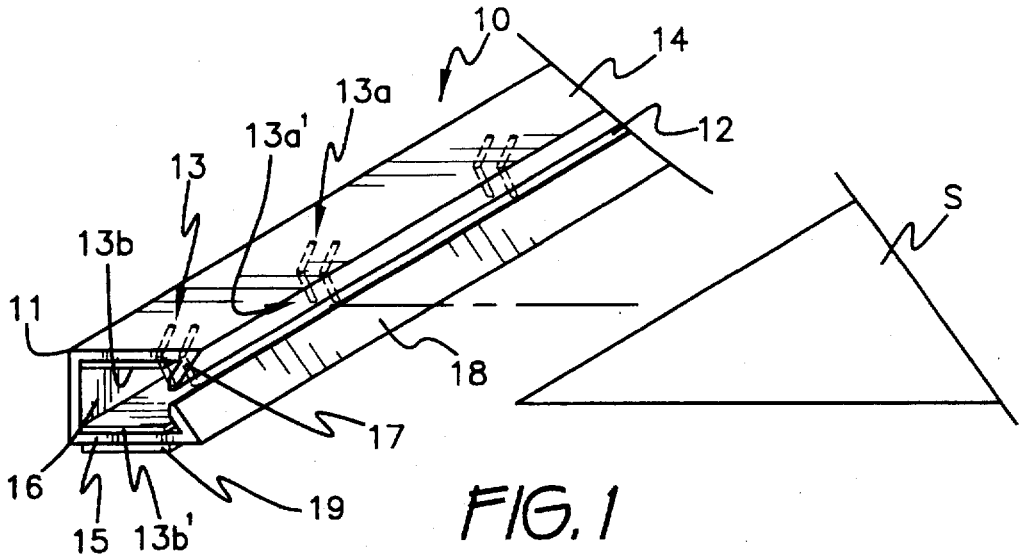
FIG. 1 is a perspective view of a part of a first embodiment of a sheet clipping device of the invention.
Figure 2:
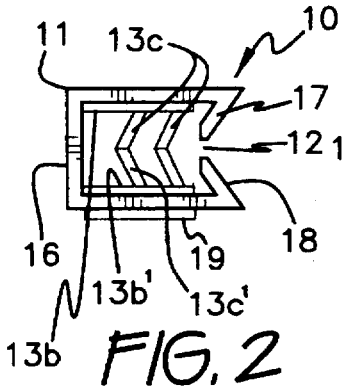
FIG. 2 is a side view of the sheet clipping device shown in FIG. 1.
Figure 3:
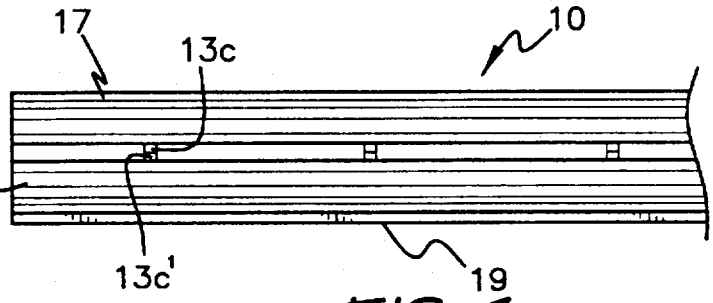
FIG. 3 is a front view of a part of the sheet clipping device shown in FIG. 1.
Figure 4:
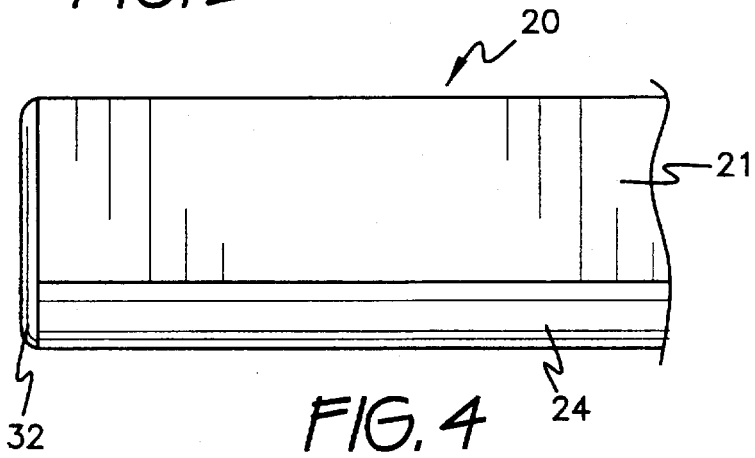
FIG. 4 is a plan view of a part of a second embodiment of a sheet clipping device of the invention.
Figure 5:
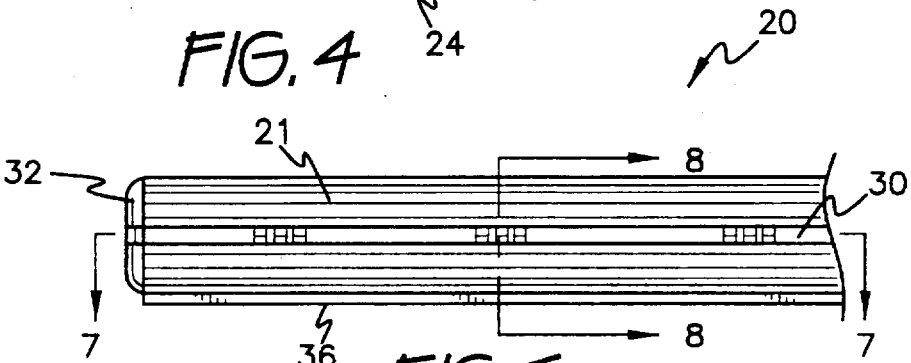
FIG. 5 is a front view of a part of the sheet clipping device shown in FIG. 4.
Figure 7:
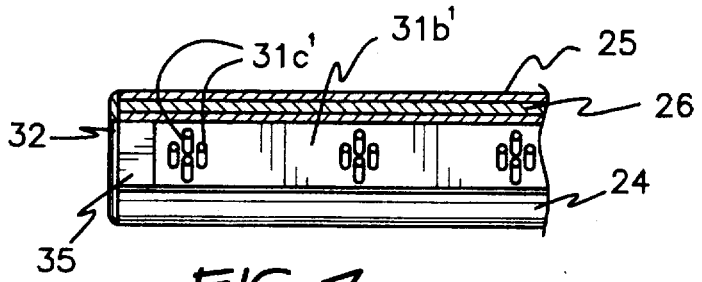
FIG. 7 is a sectional view taken along line 7—7 in FIG. 5.
Figure 6:
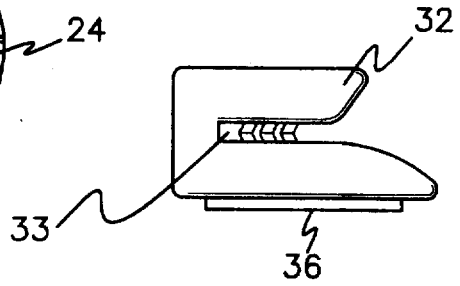
FIG. 6 is a side view of the sheet clipping device shown in FIG. 4.
Figure 8:
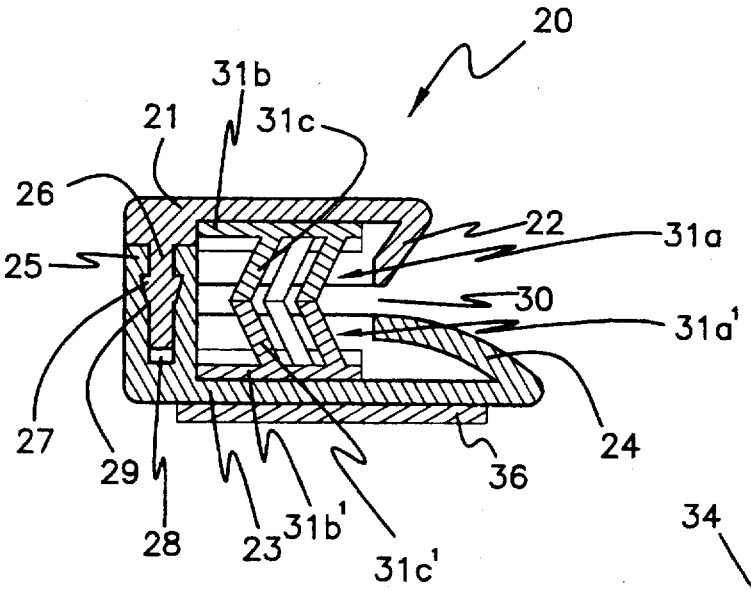
FIG. 8 is an enlarged sectional view taken along line 8—8 in FIG. 5.
Figure 9:
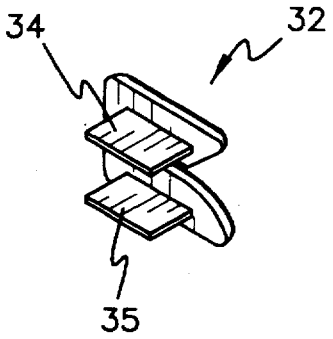
FIG. 9 is a perspective view of end plug to be attached to the sheet clipping device of the invention.
Figure 10:
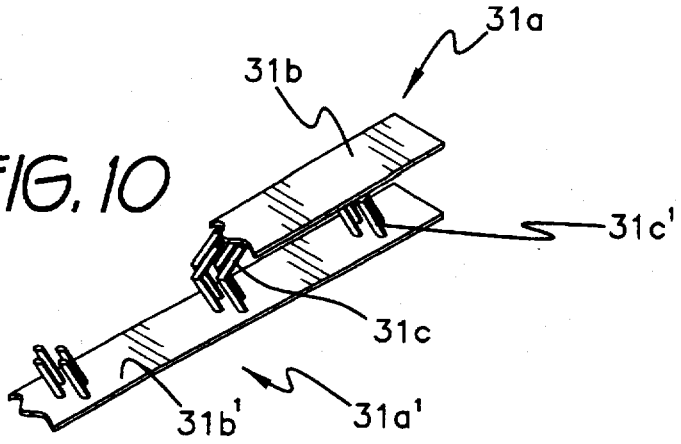
FIG. 10 is an explanatory perspective view of a part of a gripping device of the sheet clipping device of the invention.

FIGS. 1—3 show a first embodiment 10 of the sheet clipping device of the invention. The sheet clipping device 10 is formed of an elongated member 11 having an opening 12 at a front side for receiving a sheet S therethrough, and a plurality of gripping devices 13 situated in the elongated member.

The sheet clipping device 10 is formed of an upper portion 14, a lower portion 15, and a back portion 16 situated between the upper and lower portions 14, 15. The upper portion 14 includes an upper guide member 17 extending diagonally downwardly from the front side, and the lower portion 15 includes a lower guide member 18 extending diagonally upwardly from the front side. Tip portions of the upper and lower guide members 17, 18 form the opening 12 therebetween.

The gripping devices 13 are formed of upper and lower gripping devices **13*a*, 13*a*', which are formed in the same manner and arranged symmetrically relative a horizontal center plane extending through the elongated member 11. In particular, the upper gripping device 13*a* is formed of a base 13*b* extending throughout the entire length of the upper portion 14, and a plurality of hairs 13*c* extending diagonally rearwardly from the base 13*b*. The base portion 13*b* and the hairs 13*c* are integrally formed together as one unit. Two hairs 13*c* form a pair, and are arranged in a direction from the front side to the back side. The pairs of the hairs 13*c* are laterally spaced apart from each other. The distances between the pairs of the hairs 13*c*** are selected as desired.

The lower gripping device **13*a*' is formed of a base 13*b*' and a plurality of hairs 13*c*' extending diagonally rearwardly from the base 13*b*'. Two hairs 13*c*' form a pair and are arranged as in the hairs 13*c*. The tips of the hairs 13*c* slightly contact the tips of the hairs 13*c*'** to clip or hold one or more sheets S therebetween.

The gripping devices **13*a*, 13*a*'** are formed of a flexible and frictional material, such as synthetic or natural rubber or a similar material.

At a bottom of the lower portion 15, an adhesive tape 19 is attached. The elongated member 11 can be attached to a desired place, such as a wall, by the adhesive tape 19. A magnetic material may be fixed to the lower portion 15, or the lower portion 15 may be permanently fixed to a desired place.

When the sheet clipping device 10 is used, one or more sheets S are inserted into the sheet clipping device 10 through the opening 12. The ends of the sheets S are guided by the guide members 17, 18 and are introduced between the upper and lower gripping devices **13*a*, 13*a*' through the opening 12. The sheets S can be easily and firmly held between the upper and lower gripping devices 13*a*, 13*a*'. The sheets S held in the upper and lower gripping devices 13*a*, 13*a*' are not accidentally disengaged from the clipping device 10**.

In particular, when the sheet S is inserted, the sheet S pushes the hairs **13*c* or 13*c*' rearwardly to form a space between the hairs 13*c*, 13*c*'. Thus, the sheet S can enter deeply between the hairs 13*c*, 13*c*'. When the force for pushing the sheet is stopped, the hairs 13*c*, 13*c*' return to the original shapes, so that the sheet S can be held firmly between the tips of the hairs 13*c*, 13*c*'. Since the hairs 13*c*, 13*c*' orient diagonally toward the back portion 16, even if the sheet S is vertically held, the sheet S is held between the hairs 13*c*, 13*c*'. In this respect, when the pulling or removal force is applied to the sheet S, the diagonally extending hairs 13*c*, 13*c*' are urged toward the opening 12 to firmly engage the sheet S. Thus, the sheet S is not accidentally removed or disengaged from the clipping device 10**.

In the clipping device 10, after the sheets are held between the upper and lower gripping devices **13*a*, 13*a*', additional sheets may be added between the upper and lower gripping devices 13*a*, 13*a*' by simply pushing the additional sheets. The additional sheets may be entered between the sheets already held in the clipping device 10**.

When one or more sheets are removed, the one or more sheets may be strongly pulled. The sheets pulled are only removed from the clipping device 10, and the rest of the sheets are left between the upper and lower gripping devices **13*a*, 13*a*'. In particular, in case a sheet abutting against the hairs is removed, when the sheet is pulled, the tips of the hairs are turned and directed to the opening 12 by the friction with the sheet. Since the tips of the hairs are turned, the frictional force between the hairs and the sheet is reduced, so that the sheet can be relatively easily removed from the clipping device 10**. After the sheet is removed, the hairs return to the original position. Thus, a new sheet may be inserted, or if some sheets are left, the sheets left in the clipping device can be firmly retained.

In the clipping device 10, the upper and lower gripping devices 13*a*, 13*a'* are arranged laterally such that when the sheet S is inserted, at least two laterally spaced gripping devices 13*a*, 13*a'* hold the sheet S. Therefore, in case the clipping device 10 is made long, the sheet S can be held stably and firmly at any portion in the clipping device 10. The clipping devices 10 may be laterally extended as desired with or without using a connector.

Also, since the back portion 16 is flat and is located at a side opposite to the opening 12, when the sheet S is inserted through the opening 12, the end of the sheet S abuts against the back portion 16. Thus, the sheet S is aligned relative to the clipping device 10.

In the clipping device 10 of the invention, memo paper, regular thin sheet, thick sheet or plastic sheet can be properly inserted through the opening 12 by one pushing operation, and held by the clipping device 10.

FIGS. 4–10 are a second embodiment 20 of the clipping device of the invention. The clipping device 20 is basically the same as the clipping device 10, and is formed of an elongated member and gripping devices. The elongated member includes an upper portion 21 with an upper guide member 22, a lower portion 23 with a lower guide member 24, and a back portion 25 integrally formed with the lower portion 23. The upper portion 21 includes a projection 26 with lateral protrusions 27, and the back portion 25 includes a groove 28 with lateral recesses 29. When the projection 26 is inserted into the groove 28, the protrusions 27 engage the recesses 29. Thus, the upper and lower portions 21, 23 are firmly connected together as one unit.

In the clipping device 20, the lower portion 21 and the lower guide member 24 are made longer than the upper portion 21 and the upper guide member 22 in the direction from the front side to the back side. Thus, the sheet can be inserted easily into an opening 30 between the upper and lower guide members 22, 24.

As gripping devices, upper and lower gripping devices 31*a*, 31*a'* are fixed to the upper and lower portions 21, 23. The upper gripping device 31*a* is formed of a base plate 31*b* and a plurality of hairs 31*c* extending diagonally and rearwardly from the base plate 31*b*, and the lower gripping device 31*a'* is formed of a base plate 31*b'* and a plurality of hairs 31*c'* extending diagonally and rearwardly from the base plate 31*b'*. Four hairs 31*c*, 31*c'* form one group, respectively, which are spaced apart from each other. In each group, four hairs are arranged to form a diagonally inclined rectangular shape. One hair located in one corner in the rectangular shape is arranged close to the opening 30. The tips of the hairs 31*c* slightly contact the tips of the hairs 31*c'* to clip or hold one or more sheets therebetween.

In the clipping device 20, side covers 32 are attached to end portions of the elongated member. The side cover 32 includes a slit 33 having a size to allow the sheets to enter therethrough to be fixed to the gripping devices. Also, the side cover 32 includes upper and lower holding plates 34, 35, which are tightly disposed between the base plates 31*b*, 31*b'* to fix the side cover 32 to the elongated member.

The clipping device 20 also includes an adhesive tape 36 at the lower plate 23. The elongated member can be attached to a desired place, such as a wall, by the adhesive tape 36.

The clipping device 20 operates as in the clipping device 10. In addition, the gripping devices 31*a*, 31*a'* can firmly hold one or more sheet therebetween, because four hairs 31*c*, 31*c'* form one group for holding the sheet. Also, since the lower guide member 24 and the lower plate 23 are formed longer than the upper guide member 22 and the upper plate 21, the sheet can be easily guided into the opening 30 by the upper and lower guide members 22, 24. The rest of the operation is the same as that of the clipping device 10.

While the invention has been explained with reference to the specific embodiments of the invention, the explanation is illustrative and the invention is limited only by the appended claims.

What is claimed is:

1. A sheet clipping device for holding at least one sheet comprising, an elongated base member having front and back sides, said base member being formed of upper and lower portions disposed substantially parallel to each other, a back portion situated between the upper and lower portions at the back side thereof, and upper and lower guide members attached to the upper and lower portions, respectively, said upper and lower guide members facing to each other and extending diagonally from the front side to the back side, distal ends of the upper and lower guide members being vertically spaced apart from each other so that when at least one sheet is inserted between the upper and lower portions, the at least one sheet is guided into a space between the upper and lower portions, and a plurality of gripping devices fixed to the elongated base member at a predetermined distance away from each other along a longitudinal direction thereof, each of the gripping devices having upper and lower frictional members, said upper frictional member being fixed to the upper portion and said lower frictional member being fixed to the lower portion to face to each other so that when the at least one sheet is inserted between the upper and lower frictional members, the at least one sheet is frictionally retained between the frictional members.

2. A sheet clipping device according to claim 1, wherein each of the upper frictional members is fixed on the upper portion between the distal end of the upper guide member and the back portion, and each of the lower frictional members is fixed on the lower portion between the distal end of the lower guide member and the back portion.

3. A sheet clipping device according to claim 1, wherein said upper frictional members of the gripping devices spaced apart from each other are integrally connected together as one unit, and said lower frictional members of the gripping devices spaced apart from each other are integrally connected together as one unit, each of said units being fixed to the upper and lower portions, respectively.

4. A sheet clipping device according to claim 1, wherein each of the frictional members forming the upper and lower frictional members is formed of a base, and a plurality of flexible hairs extending parallel to each other and diagonally from the base, the bases of the frictional members in the upper frictional member and in the lower frictional member being integrally united together to form an upper unit and a lower unit, respectively.

5. A sheet clipping device according to claim 4, wherein said each of the frictional members includes at least four hairs, one of the four hairs being located close to the front side.

6. A sheet clipping device according to claim 1, wherein said upper and lower guide members extend substantially throughout entire lengths of the upper and lower portions, respectively.

7. A sheet clipping device according to claim 6, wherein a length of the lower portion perpendicular to a longitudinal direction of the base member is longer than that of the upper portion, and a length of the lower guide member perpendicular to the longitudinal direction of the base member is longer than that of the upper guide member, the distal ends of the upper and lower guide members being located in a same vertical plane.

8. A sheet clipping device according to claim 1, further comprising a fixing member attached to the lower portion of the base member so that the lower portion can be fixed to a desired place by the fixing member.

* * * * *